United States Patent [19]

Gloor

[11] 4,151,866

[45] May 1, 1979

[54] LOOM FOR THE WEAVING OF TWO AND/OR THREE THREAD FABRICS

[76] Inventor: Wilbur T. Gloor, P.O. Box 305, Aurora, Ohio 44202

[21] Appl. No.: 843,746

[22] Filed: Oct. 19, 1977

[51] Int. Cl.[2] ..... D03D 29/00; D03D 41/00

[52] U.S. Cl. ..... 139/29; 139/DIG. 1; 139/11

[58] Field of Search ..... 139/29-33, 139/DIG. 1, 11, 141

[56] References Cited

U.S. PATENT DOCUMENTS

| | | | |
|---|---|---|---|
| 299,610 | 6/1884 | Wright | 139/141 |
| 332,217 | 12/1885 | Strowbridge | 139/141 |
| 1,610,144 | 12/1926 | Norrman | 139/141 X |
| 3,799,209 | 3/1974 | Dow et al. | 139/DIG. 1 |
| 3,884,429 | 5/1975 | Dow | 139/DIG. 1 |
| 4,006,759 | 2/1977 | Darsie | 139/DIG. 1 |
| 4,022,250 | 5/1977 | Trost | 139/DIG.1 |
| 4,031,922 | 6/1977 | Trost et al. | 139/11 |

FOREIGN PATENT DOCUMENTS

| | | | |
|---|---|---|---|
| 484092 | 8/1953 | Italy | 139/DIG. 1 |
| 464104 | 11/1968 | Switzerland | 139/32 |

*Primary Examiner*—James Kee Chi
*Attorney, Agent, or Firm*—John F. Luhrs

[57] ABSTRACT

A manually operated loom for the weaving of two and/or three thread fabrics of various designs wherein the warp threads are individually detachably mounted and guided in opposed, axially movable arrays on parallel axes for circulation of the warp threads in clockwise or counterclockwise directions, each pair of opposed warp threads being held substantially parallel with adjacent pairs to the vertexes formed by serrations in an angularly positionable main guide running parallel to the axes of the arrays, means for reciprocating the arrays toward and away from each other to interchange the positions of the warp threads in each pair of opposed warp threads to form closed and open sheds respectively, means for passing a weft thread through a shed and an axially movable, angularly positionable control guide running parallel with the main guide for positioning a weft thread over the main guide to complete the weave and for shifting the warp threads of an array to adjacent serrations in the formation of three thread fabrics.

9 Claims, 13 Drawing Figures

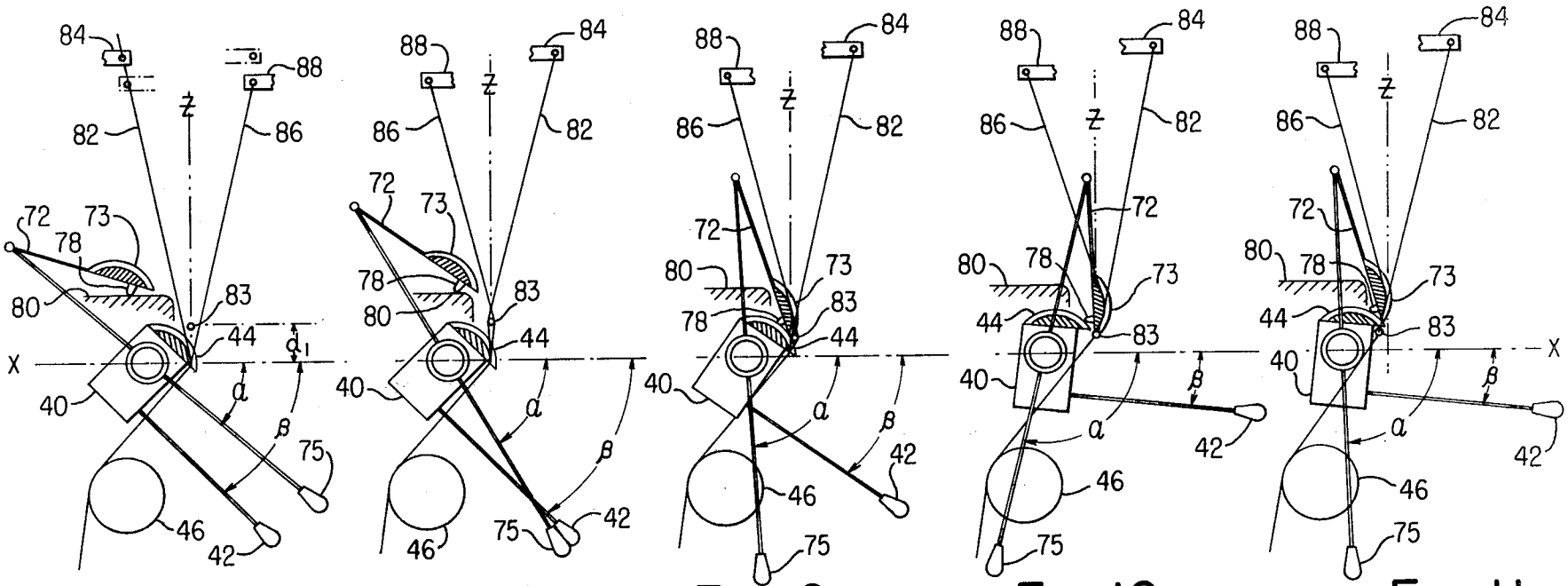
FIG. 7
FIG. 8
FIG. 9
FIG. 10
FIG. 11
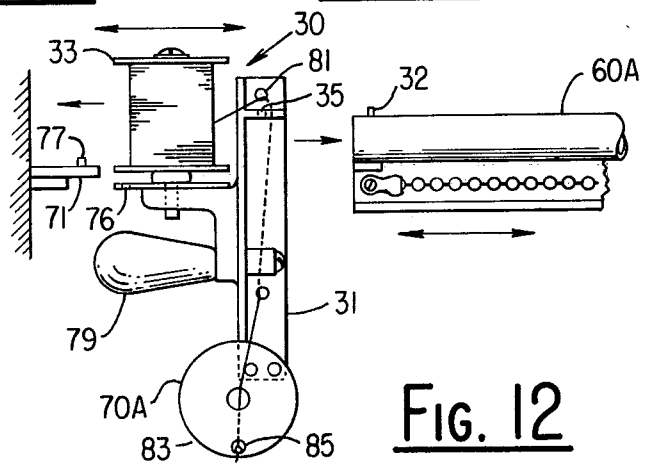
FIG. 12

LOOM FOR THE WEAVING OF TWO AND/OR THREE THREAD FABRICS

This invention relates to a manually operated loom for the weaving of fabrics.

One object of the invention is to provide a loom of compact design and of relatively light weight, making it particularly suitable for use by the home craftsman and textile manufacturers involved in research and/or the production of fabrics of inovative texture and design.

A further object of the invention is to provide a loom for the conventional orthagonal two-thread weaving.

Still another object of the invention is to provide a loom for triweaving which is the intertwining of three threads producing a staple fabric having unusual bias strength and non-raveling characteristics.

A further object of the invention is to provide a loom for the combination of two and three thread weaving with or without discontinuous warp weaving to produce fabrics of various designs and characteristics.

A further object of the invention is to provide a loom requiring only hand motions for operation.

These and further objects of the invention will be apparent as the description proceeds in connection with the drawings in which:

IN THE DRAWINGS

FIGS. 7–11 are schematic illustrations useful in explaining the operation of the main and control guides in forming a weave of desired configuration.

FIG. 12 is a fragmentary view illustrating an alternate means for carrying a weft thread back and forth between the warp threads when in a shed.

DETAILED DESCRIPTION

Figure 1:
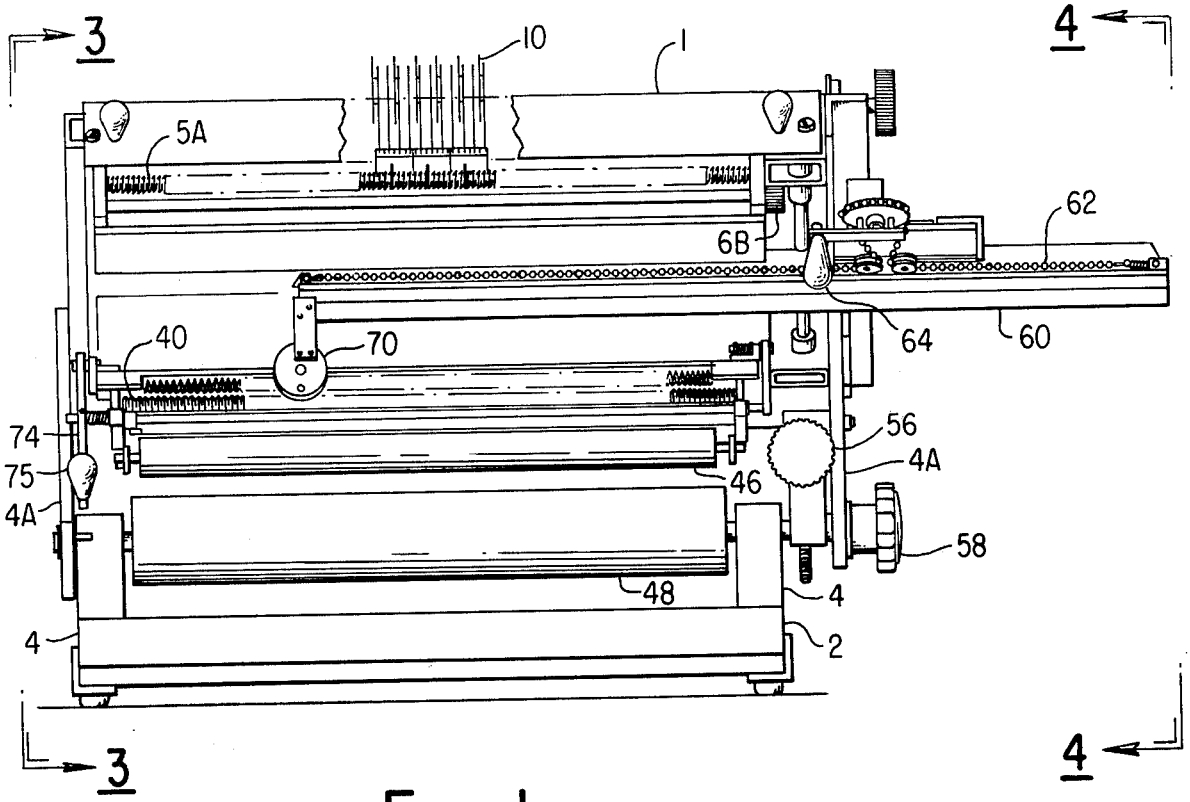
FIG. 1 is a front elevation view of the loom in the weave tilt position as shown in side elevation views in FIGS. 3 and 4.
Figure 2:
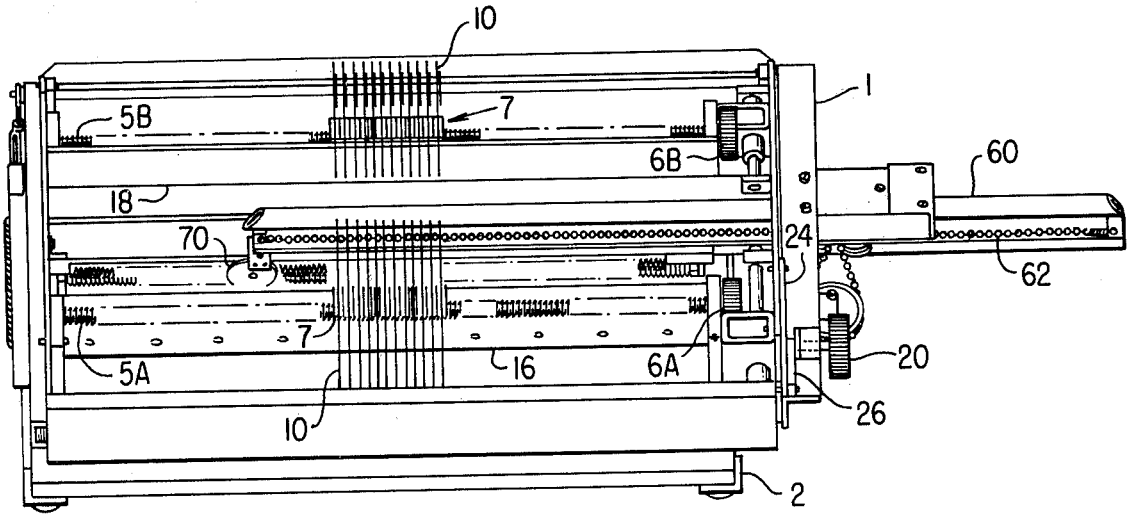
FIG. 2 is a top plan view of the loom in the warp transfer tilt position.
Figure 3:
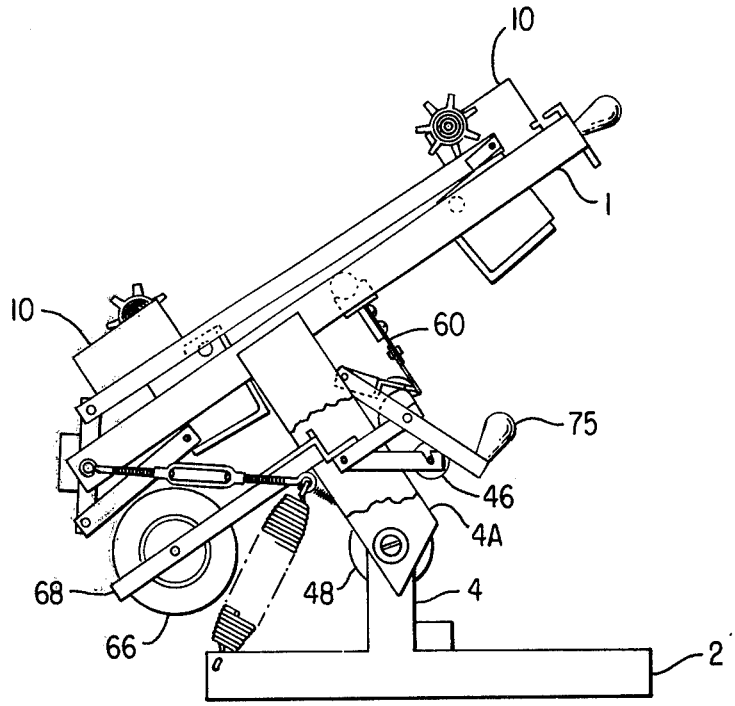
FIG. 3 is a side elevation view taken along the line 3—3 in the view shown in FIG. 1.
Figure 4:
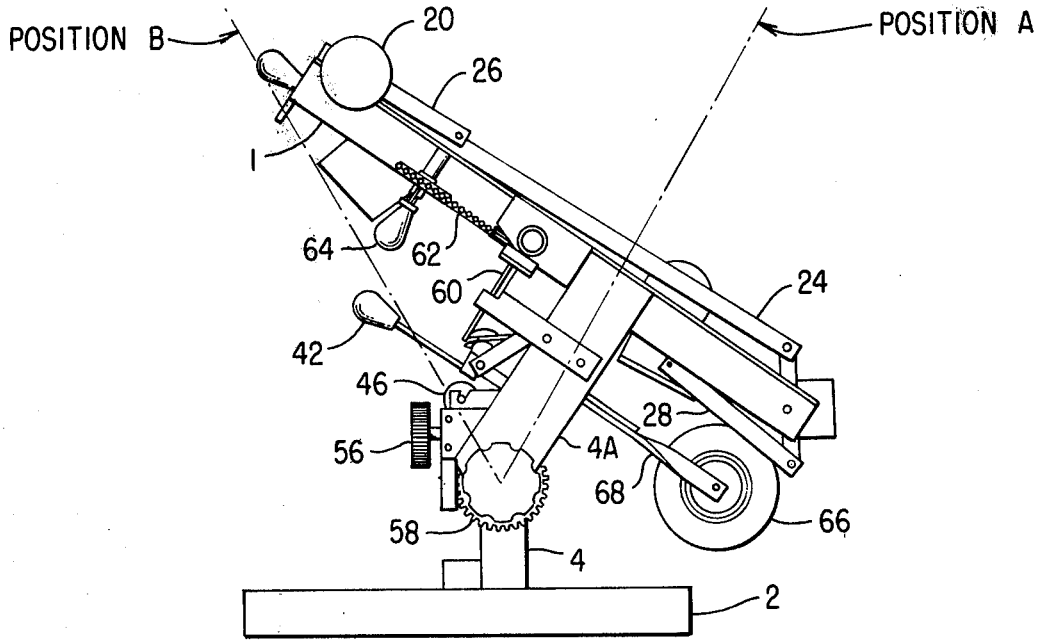
FIG. 4 is a side elevation view taken along the line 4—4 in FIG. 1.

Referring to the drawings wherein like reference characters designate like or corresponding parts throughout the several views there is shown a base 2 having arms 4 in which are journaled the arms 4A of a rectangular frame 1 manually tiltable from a weave tilt position as shown in FIGS. 1, 3 and 4 to a warp transfer tilt position as shown in FIG. 2, identified as positions A and B respectively in FIG. 4. When in the weave tilt position the controls are exposed to an operator when facing the loom so that successive weaving operations may be performed. When in the warp transfer tilt position the warp arrays are in the line of vision of the operator facilitating circulation of the warp threads by indexing the warp arrays in one direction or the other and by transfer of a warp thread from one array to the other.

The entire operating mechanism of the loom, with the exception of a fabric roll 48, which is journaled in the arms 4, is supported by the frame 1. While the parts making up the mechanism are identified in FIGS. 1–4, reference should be made to FIG. 5 in the following the description, as this Fig. illustrates what may be termed a transverse schematic cross section of the loom mechanism, with some parts displaced from true position for clarity. In this Fig. conventional ground markings should be interpreted to mean the essential points of support of the mechanism in the frame 1.

Supported by the frame 1 are bearings 12 and 14 on which are slidably supported at one end a front cross member 16 and a rear cross member 18 which may be supported at their opposite ends by similar bearings mounted on the frame 1 or by other means such as rollers guided in suitable ways (not shown) in the frame 1.

Figures 5, 6A, 6B:
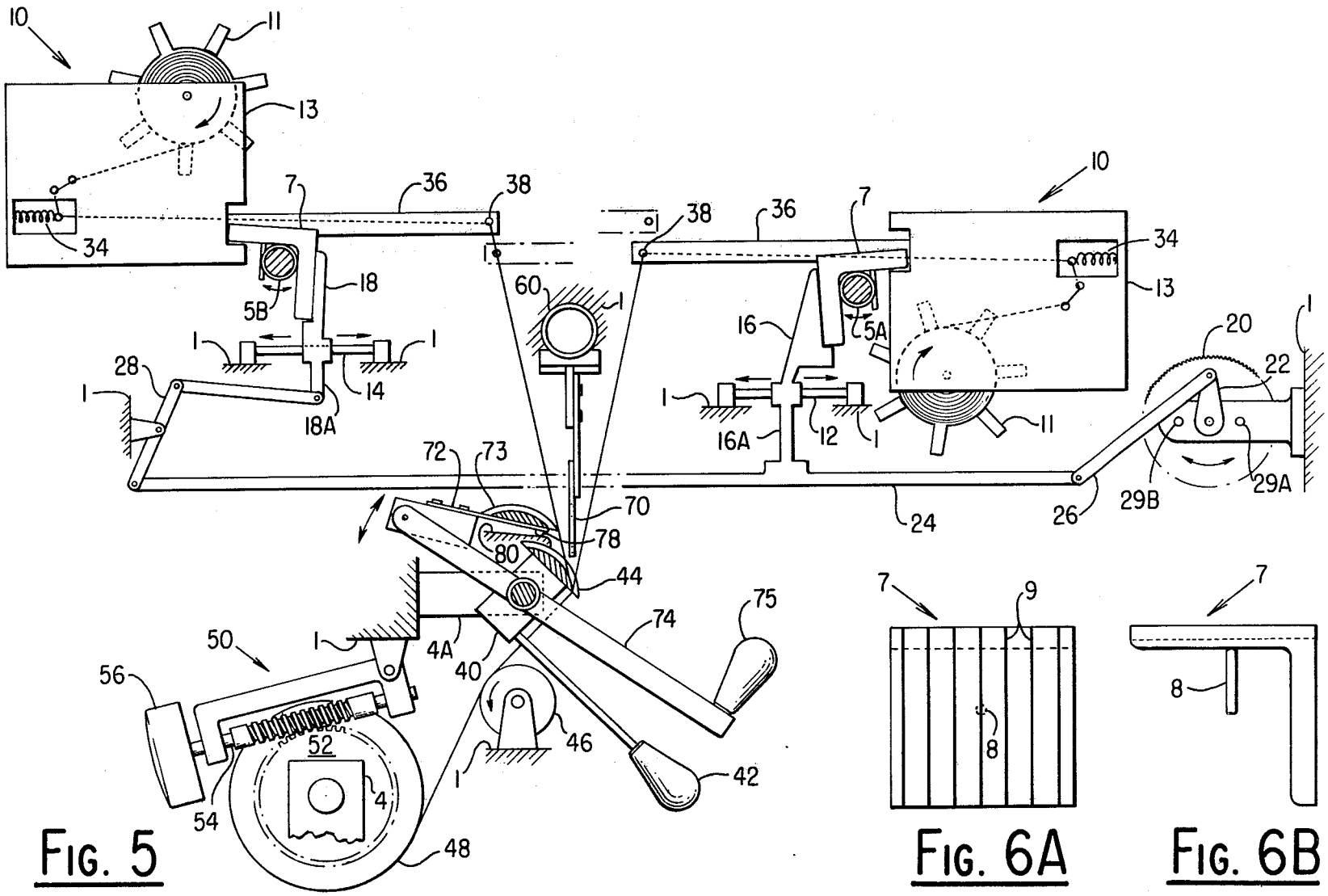
FIG. 5 is a schematic illustration useful in explaining the construction and operation of the loom.
FIGS. 6A and 6B are top plan and side elevation views respectively of typical spacers used in arranging the warp arrays.

The cross members 16 and 18 are simultaneously moved toward and away from each other to predetermine limits by rotation of a knob 20 operably connected to the cross members through a linkage shown diagrammatically in FIG. 5. Journaled in the frame 1 is a crank arm 22, secured to the knob 20. Pivotly connected to the crank arm 22 and a connecting rod 24 is a link 26. The connecting rod 24 is secured to the cross member 16 through an extension 16A and through a reversing link 28 to the extension 18A of cross member 18. Thus the cross members 16 and 18 will simultaneously be moved in opposite directions, that is to say, toward and away from each other, to preset limits by rotation of the knob 20 in one direction or the other. The cross members 16 and 18 are shown in mid position. Rotation of the knob 20 in a clockwise direction will cause cross members 16 and 18 to move away from each other to a limit set by a stop 29A, which, for reasons apparent as the description proceeds, is defined as the open shed position. Rotation of the knob 20 in a counterclockwise direction will cause members 16 and 18 to move toward each other to a limit set by a stop 29B and which is defined as the closed shed position.

Journaled in the front cross member 16 at both ends is a front warp translate screw 5A and a similar rear warp translate screw 5B journaled in the rear cross member 18 provided with knobs 6A and 6B (FIG. 2) respectively for rotating these screws in clockwise and counter clockwise directions. Carried by the screws 5A and 5B are one or more removable spacers 7, each having a pin 8 engaging a thread of a translate screw and a flat face engaging a way formed in one or the other of cross members 16, 18. Thus as a translate screw is rotated in one direction the spacer, or spacers, mounted thereon are moved to the left and when rotated in the opposite direction are moved to the right. When knobs 6A and 6B are rotated in opposite directions the spacers mounted on one translate screw will be axially positioned in opposite direction to the spacer, or spacers, mounted on the other translate screw.

Referring to FIG. 6A, each spacer 7 has a plurality of slots for supporting and locating the warp units to maintain a desired separation of and to assist in guiding the warp threads. As shown in FIG. 5, each warp unit 10 comprises a warp thread supply reel 11 rotatably mounted on a support plate 13 which is proveded with a thread tension control unit 34 and a finger 36 having a guide eye 38. The warp units are universal to allow their use as an upper or lower threading type, which when alternately utilized permit greater reel space to remove possible interference with adjacent warp units.

By way of example, and not as a limitation, each spacer 7 may be one inch long and provided with slots 9 for receiving seven warp units, thus a pair of opposed spacers will provide a total of fourteen warp threads per inch. The number of front and rear spacers and hence the number of warp threads employed in any particular case will be determined by the width of fabric to be woven. The pitch of the thread on the translate screws 5A and 5B may be such that a given number of revolutions of the knobs 6A or 6B, for example, two, indexes a warp unit one warp thread spacing. As will be evident as the description proceeds the axial indexing of the warp units provides a means for generating three thread weaving of the oscillating-warp type, or of the circulating warp type, wherein, in an open shed, the warp threads forming the front array are indexed in one direction and those forming the rear array are indexed in the opposite direction and circulation maintained by transferring the overhanging warp unit on the front array to the rear array and the overhanging warp unit on the rear array to the front array, and further, as required, transfering a spacer from the front to the rear translate screw and vice versa. Such circulation of the warp threads in conjunction with the transverse weft threads will produce a woven fabric similar to that shown in U.S. Pat. No. 1,368,215.

Journaled in the arms 4A of the frame 1 is a main guide 40, angularly positionable between limits by means of a hand operator 42 which is provided with semi-circular serrations or teeth 44 having a pitch equal to the spacing between adjacent warp units and subtending an angle less than one hundred eighty degrees to form a sharp lower lip for catching and positioning a weft thread at the appropriate point in each cycle of operation.

As shown in FIG. 5 the warp threads from each opposed pair of warp units 10, after passing through guide eyes 38 are carried through the same tooth on the main guide 40 to a temple roll 46, removably journaled in the arms 4A and thence on to the fabric roll 48. To maintain the desired tension on the warp threads during loom setup or the weaving operation, the fabric roll 48 may be rotated through a worm feed generally indicated at 50 comprising a gear 52 and a disengageable helical screw 54 rotatable by means of a knob 56, or by a direct feed knob 58 when the helical screw 54 is disengaged from the gear 52.

Weft threads may be inserted when the warp units, and consequently the warp threads, are in the open or closed shed position by means of a rapier 60 journaled in the frame 1 and propelled through the shed by means of a chain drive 62 operated by a knob 64. A weft thread supply spool 66 is carried on brackets 68 and the weft thread therefrom is guided along the rapier through a weft thread position guide 70, mounted on the rapier 60, and thence back adjacent to the rapier. In operation, assuming the warp threads form an open or closed shed, the rapier carries a weft thread from the right side of the loom as viewed in FIGS. 1 and 2 to the left side and thence back to the right side, forming looped weft ends at the right and left sides of the fabric as it is formed by the intertwining of the warp and weft threads upon the positioning of the warp threads to alternate sheds between insertion of the weft threads.

After a weft thread has been laid between the warp threads and the rapier 60 withdrawn from the loom, the weave is completed by means of an auxiliary control guide 72 pivotly connected to arms 74 loosely journaled coaxially with the main control guide 40. Conveniently, the left hand arm 74 is provided with an extension carrying a knob 75 for angular positioning of the arm and consequently of the auxiliary control guide 72. The control guide 72 is provided with semi-circular serrations or teeth 73 having the same pitch as the serrations on the main guide 40 and is spring urged to a transverse neutral position wherein the serrations or teeth are at one half tooth spacing relative to the teeth or serrations on the main guide 40. By means of suitable stops, the serrations or teeth on the control guide 72 are brought into alignment with those on the main guide 40 by transverse operation of the knob 75, the control guide serrations or teeth being restored to the neutral position upon release of the knob 75. The serrations or teeth on the control guide 72 also subtend an angle less than one hundred eighty degrees to form a sharp lower lip to position a weft thread over the periphery of the serrations in main guide 40 at the appropriate point in each cycle of operation. As shown, the control guide 72 is provided with a follower pin 78 riding upon a stationary cam 80 and hence follows a predetermined trajectory as the knob 75 is angularly positioned.

Having described the mechanical elements making up the essential mechanism of a loom incorporating the principle features of the invention, the functions of the main guide 40 and control guide 72 in generating a fabric will now be described.

FIG. 7 illustrates the weave control at rest with a weft thread 83 inserted at distance $d_1$ relative to the axis X—X and the opposed warp arrays as exemplified by a thread 82 carried by a finger 84 of a warp unit (not shown) and a warp thread 86 carried by a finger 88 of a warp unit (not shown) in open shed.

In FIG. 8 the shed is shown closed, the positions of threads 82 and 86 being exchanged to trap the weft thread 83 in the foldover of the warp threads.

In FIG. 9 the angle Alpha has been increased by clockwise positioning of control guide knob 75 and the angle Beta has been decreased by counterclockwise positioning of hand operator 42 of the main guide 40. The follower pin 78 has been positioned beyond the cam 80 and the control guide 72 rests upon the surface of the main guide 40. The control guide 72 thus assumes control of the transverse spacing of the warp threads; but the weft thread 83 remains essentially on the Z axis, trapped under the teeth of the control guide 72 above the main guide 40.

In FIG. 10 the angle Alpha has been increased due to further rotation of the control guide knob 75 in a clockwise direction and the angle Beta has decreased due to further rotation of the hand operator 42 in a counterclockwise direction. Weft thread 83 has been carried below main guide 40 but still remains essentially on the Z axis and control guide 72 continues to ride on main guide 40.

In FIG. 11 the angle Alpha has decreased due to counterclockwise rotation of control guide knob 75, whereas the angle Beta has remained unchanged. Weft thread 83, due to the tension of warp threads 82, 86 shifts to the left and is trapped under the main guide 40. Setting of the weft thread to form fabric is done by restoring the relationship of main guide 40 and control guide 72 as shown in FIG. 7. With the warp threads 82, 86 remaining in the closed shed position a weft thread may be passed through the shed and the operations illustrated in FIGS. 7–11 repeated. By repetitive operations with the shed alternately open and closed formation of the fabric proceeds.

As evident, by transverse movement of the guide 72 in one direction or the other an intertwining of the warp threads with the weft threads may be accomplished. Such intertwining in conjunction with circulation of the warp threads as heretofor described can be used to produce fabrics of a wide variety of weaves.

As evident from the foregoing description, during each weave cycle the rapier 60 is moved from its retracted position, shown as at the right side in FIGS. 1 and 2 to the opposite side and thence back to the retracted position. Two weft threads are therefor laid during each cycle. In FIG. 12 an alternate arrangement is shown whereby the loom can produce, for example, conventional orthagonal two-thread weaving. Shown is a shuttle, generally indicated at 30, comprising a bracket 31 which may be either detachably fastened to a rapier 60a by means of a hole 35 adapted to receive a pin 32, or to a bracket 71 mounted on the left side of the rectangular frams 1, by means of a hole 76 adapted to receive a pin 77. Rotatably mounted on the bracket 31 is a bobbin 33, carrying a supply of weft thread, replacing the weft supply spool 66 shown in FIG. 4. Secured to the lower end of bracket 31 is a thread position guide 70A.

In operation, assuming the rapier 60A to be in the retracted position and the shuttle 30 clipped thereto, with the warp threads in open shed, the rapier is extended to the left side of the loom, laying a weft thread along the vertex of the shed. Upon the rapier reaching the left side of the loom, the shuttle 30 is removed from the rapier 60A and clipped to the bracket 71. The rapier 60A is then withdrawn to the right side. The shed is then reversed and the weave operation completed by the cooperative movements of main guide 40 and control guide 72. The rapier 60A is then moved from the right side to the left side of the loom, the shuttle 30 transferred from the bracket to the rapier which is then returned to the right side, laying a weft thread as it traverses the shed. The shed is then reversed and the weave operation completed.

The bracket 31 may be provided with one or more guide eyes, such as shown at 81, through which the weft thread is threaded before leaving a weft guide eye 85, and a handle 79 for transfering the shuttle.

I claim:

1. In a loom for the weaving of fabric, comprising in combination, a pair of spaced apart parallel members each supporting an array of warp threads in opposed staggered relationship with the warp threads on the other of said members, a main control guide running parallel with said members disposed between said members but displaced from the plane of said members provided with serrations, each serration adapted to receive a pair of warp threads, one thread of said pair from one of said arrays and the other thread of said pair from the other of said arrays to form an open shed, means for positioning said members toward each other to a position wherein each array of warp threads is moved to the initial position of the other array of warp threads to thereby form a closed shed, a rapier for passing a weft thread between said arrays of warp threads adjacent to said main guide when said warp threads are in open or closed shed, an auxiliary control guide running parallel with said main guide and means for positioning said auxiliary guide over the surface of said main guide whereby said weft thread is positioned over the surface of the main guide.

2. The combination according to claim 1 wherein the serrations on said main guide have a pitch equal to the spacing between adjacent warp threads in any array of warp threads.

3. The combination according to claim 1 wherein said auxiliary control guide is provided with serrations having the same pitch as the serrations on said main guide.

4. The combination according to claim 3 wherein said auxiliary guide is axially movable in either direction relative to said main guide whereby the arrays of warp threads can be moved from the serrations on the main guide originally engaging the warp threads to engagement with the adjacent serrations in the main guide.

5. The combination according to claim 4 wherein said auxiliary guide is axially movable in either direction from a neutral position wherein the serrations on said auxiliary guide are axially displaced one half the pitch of the serrations on said main guide.

6. The combination according to claim 1 further including means for axially moving each of said arrays relative to its supporting member.

7. The combination according to claim 6 further including a warp unit comprising a reel for storing a supply of warp threads and means on each of said parallel support members for removably receiving and axially spacing a plurality of said warp units to thereby form an array of warp threads.

8. The combination according to claim 7 wherein said last named means comprises a plurality of spacer blocks each provided with a plurality of evenly spaced slots, each slot adapted to receive one of said warp units.

9. The combination according to claim 1 further including a shuttle comprising a bobbin for storing a supply of weft thread and guide means for placing a weft thread from said bobbin adjacent to said main guide and means for detachably mounting said shuttle on said rapier to carry said shuttle back and forth between said arrays of warp threads.

* * * * *